US005463408A

United States Patent [19]

Mio

[11] Patent Number: 5,463,408

[45] Date of Patent: Oct. 31, 1995

[54] LIQUID-CRYSTAL DISPLAY

[75] Inventor: Masao Mio, Hyogo, Japan

[73] Assignee: Mitsubishi Denki Kabushiki Kaisha, Tokyo, Japan

[21] Appl. No.: 258,904

[22] Filed: Jun. 13, 1994

Related U.S. Application Data

[63] Continuation of Ser. No. 11,033, Jan. 29, 1993, abandoned.

[30] Foreign Application Priority Data

Feb. 18, 1992 [JP] Japan ..... 4-069013

[51] Int. Cl.[6] ..... G09G 3/18

[52] U.S. Cl. ..... 345/52; 345/50

[58] Field of Search ..... 345/52, 87, 211, 345/212, 213, 50, 51, 53, 98, 99; 307/296.1, 296.3, 639, 44

[56] References Cited

U.S. PATENT DOCUMENTS 3,315,095 4/1967 Blumberg ..... 307/296.1
4,168,498 9/1979 Kubota ..... 345/87
4,309,701 1/1982 Nishimura ..... 307/296.3
4,486,748 12/1984 Nonomura ..... 345/52
5,218,352 6/1993 Endoh ..... 345/50

OTHER PUBLICATIONS

Mims, F. "Engineer's Notebook". pp. 7–8, 1980.

*Primary Examiner*—Curtis Kuntz
*Assistant Examiner*—Vivian W. Chang
*Attorney, Agent, or Firm*—Townsend and Townsend and Crew

[57] ABSTRACT

A liquid-crystal display according to this invention which incorporates timing signal generation circuit 13 which turns on switches 10 to 12 when interval control signal P from the liquid-crystal power supply circuit is in active status, and which turns switches 10 to 12 off when interval control signal P is in inactive status. By turning switches 10 to 12 off when no display is required, current flow from power supply 3 to ground (GND) is cut and power consumption is reduced.

6 Claims, 6 Drawing Sheets

LIQUID-CRYSTAL DISPLAY

This is a Continuation of application Ser. No. 08/011, 033, filed Jan. 29, 1993, now abandoned.

BACKGROUND OF THE INVENTION

1. Field of the Invention

The present invention relates to liquid-crystal displays able to operate with reduced power consumption.

2. Description of the Prior Art

A block diagram showing the structure of a conventional liquid-crystal display is shown in FIG. 6. The figure is a block diagram of a (⅓) bias liquid-crystal display drive circuit comprised of liquid-crystal display panel 1, liquid-crystal display driver 2, power supply 3, resistors 4 to 6, ground (GND) 7, and frame frequency generator circuit 20. Liquid-crystal display panel 1—a liquid-crystal panel with a structure to be described below—displays text and pictures by on or off action of liquid-crystal picture elements. In synchronization with the frame frequency signal FL from frame frequency generator circuit 20, liquid-crystal display driver 2 sends output signal COMO, S1 . . . Sn to liquid-crystal display panel 1, causing each liquid-crystal picture element to turn on or off. Positioned between power supply 3 and ground (GND) 7 are resistors R, which have the same resistance value and provide 3 voltage levels—VL1, VL2 and VL3—that are input to power supply terminals $\mathbf{2}_a$ to $\mathbf{2}_c$ of liquid-crystal display driver 2. Frame frequency generator circuit 20 outputs to liquid-crystal driver 2 frame frequency signal FL which determines whether each picture element is turned on or off.

As shown in FIG. 7, the liquid-crystal display panel described above consists of common electrode $\mathbf{1}_0$, segment electrodes $\mathbf{1}_{a2}$ to $\mathbf{1}_{an}$ which are provided as resistance to common electrode $\mathbf{1}_0$, substrates $\mathbf{1}_c$ and $\mathbf{1}_d$, and liquid-crystal $\mathbf{1}_b$. The polarizing board and other items unnecessary to this explanation are not shown in FIG. 7 Signals COMO, $S_1$, $S_2$, $S_3$, . . . $S_n$ (shown within parentheses in FIG. 7) from liquid-crystal display driver 2 are input to common electrode $\mathbf{1}_0$ and segment electrodes $\mathbf{1}_{a1}$, $\mathbf{1}_{a2}$, $\mathbf{1}_{a3}$ . . . $\mathbf{1}_{an}$, respectively. When the signals from liquid-crystal display driver 2 are input, the picture element turns on if the voltage difference between segment electrodes or between each segment electrode and common electrode 1o is higher than the constant threshold level of liquid-crystal display panel 1, or turns off if it is lower.

FIG. 8 is a timing diagram showing the waveforms of (⅓) bias, quarter-time-division signals COMO $S_1$, $S_2$, $S_3$, . . . $S_n$ output from liquid-crystal driver 2 to liquid-crystal display panel 1. In FIG. 8, FL is the frame frequency signal that is sent from frame frequency generator circuit 20 to liquid-crystal driver 2, and COMO, $S_1$, $S_2$, $S_3$, . . . $S_n$ are signals sent from liquid-crystal driver 2 to con,non electrode lo and segment electrodes $\mathbf{1}_{a1}$, $\mathbf{1}_{a2}$, $\mathbf{1}_{a3}$ . . . $\mathbf{1}_{an}$ of liquid-crystal display panel 1. Intervals $T_2$, $T_3$ and $T_6$ are the on intervals of the picture elements, while intervals $T_1$, $T_4$ and $T_5$ are the off intervals.

Next, the operation of a conventional liquid-crystal display is explained using FIGS. 6 to 8. Power supply voltage $V_L$ of power supply 3 is divided into three voltage levels through resistors R of the same resistance value, with $V_{L3}=V_L$, $V_{L2}=(⅔)\ V_L$, and $V_{L1}=(⅓)\ V_L$. These voltages are then input to liquid-crystal driver 2 with power supply $V_{L3}$ input to power supply input terminal $\mathbf{2}_a$, power supply $V_{L2}$ to power supply input terminal $\mathbf{2}_b$, and power supply $V_L$ to power supply input terminal 20. Liquid-crystal driver 2 outputs the COMO, $S_1$, $S_2$, $S_3$, . . . $S_n$ signals—in synchronization with the frame frequency signal FL from frame frequency generator circuit 20—to common electrode lo and segment electrodes $\mathbf{1}_{a1}$, $\mathbf{1}_{a2}$, $\mathbf{1}_{a3}$ . . . $\mathbf{1}_{an}$ of liquid-crystal display panel 1 shown in FIG. 7. Picture elements of liquid-crystal display panel 1 are turned on during intervals $T_2$, $T_3$ and $T_6$, and turned off during intervals $T_1$, $T_4$ and $T_5$, as shown in FIG. 8. During interval $T_2$, the picture elements within the area comprised of common electrode $\mathbf{1}_0$ and segment electrode $\mathbf{1}_{an}$ are turned on by the COMO and $S_n$ output signals. During interval $T_3$, the picture elements within the area comprised of segment electrodes $\mathbf{1}_{a1}$and fan are turned on by the $S_1$ and $S_n$ output signals. During interval $T_6$, the picture elements within the area comprised of common electrode $\mathbf{1}_0$ and segment electrodes $S_n$ are turned on by the COMO and $S_n$ output signals. In other words, looking at the voltage difference between the COMO and $S_n$ output signals during interval $T_2$, the voltage difference between GND (earth) and $V_{L3}$ is added to the voltage difference between common electrode $\mathbf{1}_0$ and segment electrode $\mathbf{1}_{an}$. At this time, if the threshold voltage is greater than (⅔) $V_L$, the voltage difference $V_L$ between common electrode $\mathbf{1}_0$ and segment electrode $\mathbf{1}_{an}$ becomes greater than the threshold voltage. As a result, the picture elements in the area comprised of common electrode $\mathbf{1}_0$ and segment electrode $\mathbf{1}_{an}$ turn on. In the same way, during interval $T_3$, the picture elements in the area comprised of segment electrode $\mathbf{1}_{a1}$and common electrode $\mathbf{1}_0$ are turned on by voltage difference $V_L$, and during interval $T_6$, the picture elements within the area comprised by segment electrode $\mathbf{1}_0$ and segment electrodes $\mathbf{1}_{an}$ are turned on by voltage difference $V_L$. During intervals $T_1$, $T_4$, and $T_5$, since the voltage difference of the signals added to that between segment electrodes or common electrodes falls below the (⅔) VL threshold level, the picture elements turn off.

Due to the structure of a conventional liquid-crystal display as described above, it is necessary to generate plural power voltages required for display in the liquid-crystal display circuit, and thus current must constantly flow through resistors in order to divide the power supply into various voltages in respect to ground (GND). This constant current flow causes the problem of higher power consumption.

SUMMARY OF THE INVENTION

Accordingly, it is the object of the invention to obtain a liquid-crystal display without the problem described above, whereby the liquid-crystal display or a simple circuit provides a structure in which current does not flow from the power supply to ground (GND) when there is no display.

According to the invention, there is provided a liquid-crystal display as shown in FIG. 1, comprised of liquid-crystal driver 2 that drives the liquid-crystal display circuit (liquid-crystal display panel 1); liquid-crystal display power supply control circuit 21 which—in synchronization with changes in an output signal sent to the said liquid-crystal display circuit—outputs an interval control signal P before and after the said output signal with each frame cycle of the liquid-crystal display drive; and liquid-crystal power supply generation circuit 30 which supplies plural power supply voltages ($V_{L1}$ to $V_{L3}$) of different levels required for display in the said liquid-crystal display circuit to the said liquid-crystal display drive circuit when the said interval control signal changes to active status, and which maintains each of the said power supply voltages in floating condition through condensers 14 and 15 connected to the said power supply voltages when the said interval control signal changes to inactive status.

FIG. 4 shows a liquid-crystal display related to another invention, comprised of liquid-crystal driver 2 for driving the liquid-crystal display circuit (liquid-crystal display panel 1); timer circuit 16 which outputs interval control signal PO at specific intervals; and liquid-crystal power supply generation circuit 30 which supplies plural power supply voltages ($V_{L1}$ to $V_{L3}$) of different levels required for display in the said liquid-crystal display circuit to the said liquid-crystal display driver when the said interval control signal changes to active status, and which maintains each of the said power supply voltages in floating condition through condensers 14 and 15 connected to the said power supply voltages when the said interval control signal changes to inactive status.

A liquid-crystal display according to the invention whereby the output of an interval control signal by the said liquid-crystal power supply control circuit in each frame cycle of the said liquid-crystal driver and in synchronization with changes in output signal to the said liquid-crystal display circuit is accompanied by the supply of plural power supply voltages of different levels required for display in the said liquid-crystal display circuit to the said liquid-crystal display driver by the said liquid-crystal power supply generation circuit when the said interval control signal is active, or the maintenance of the said power supply voltages in floating condition through condensers 14 and 15 connected to the said power supply voltages when the said interval control signal is inactive. In other words, power supply voltages are supplied to the liquid-crystal driver from the liquid-crystal power supply generation circuit when the said liquid-crystal display circuit is displaying (i.e., when the interval control signal is in active status), and condensers are used to hold the supply voltages to the liquid-crystal driver from the liquid-crystal power supply generation circuit when the liquid-crystal display circuit is not displaying (i.e., when the interval control signal is in inactive status), thus stopping the flow of current from the power supply to ground (GND) within the liquid-crystal power supply generation circuit. As a result, the power consumption of the liquid-crystal display is reduced.

In addition, a liquid-crystal display according to another invention whereby the timing for supplying or holding the supply voltages from the liquid-crystal power supply generation circuit to the liquid-crystal driver is preset in the said timer circuit.

The above and other objects, features, and advantages of the Invention will become more apparent from the following description when taken in conjunction with the accompanying drawings.

DESCRIPTION OF THE PREFERRED EMBODIMENT

Figure 1:
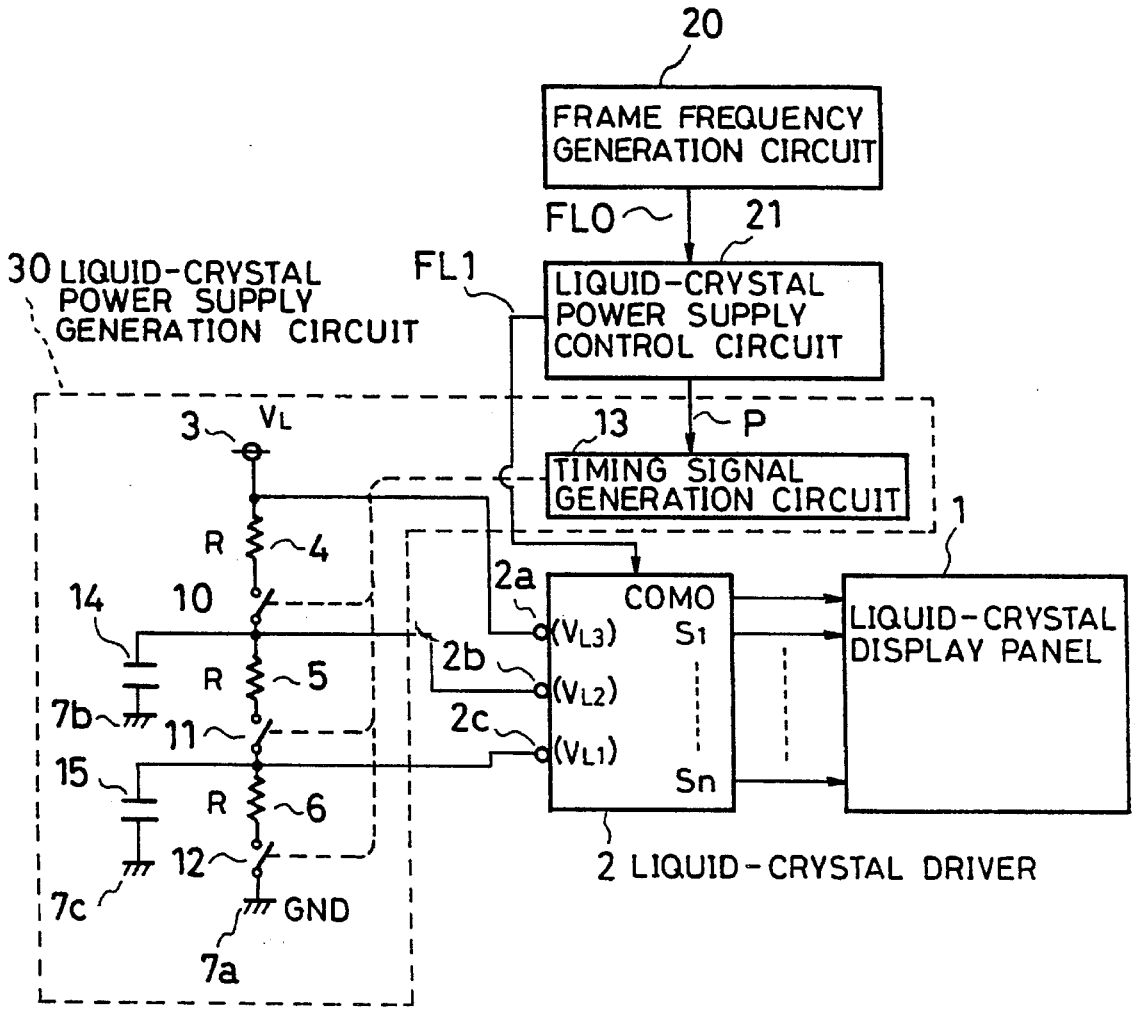
FIG. 1 is a block diagram of a liquid-crystal display driver according to an embodiment of the invention.
Figure 6:
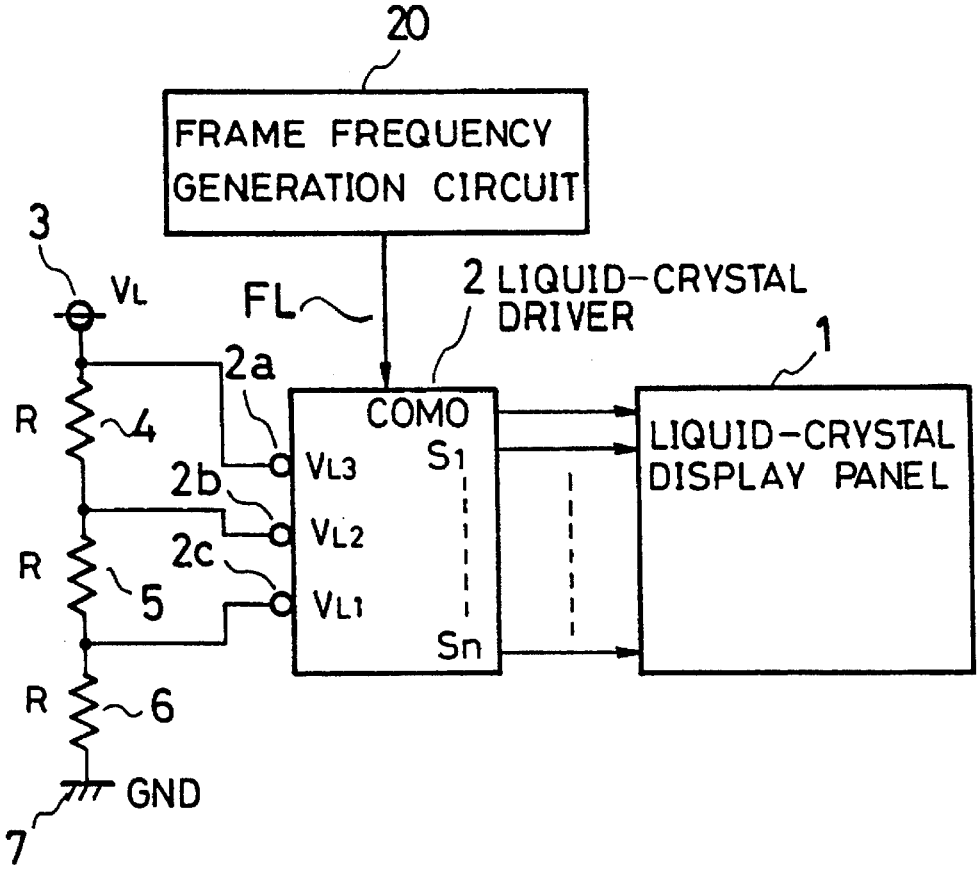
FIG. 6 PRIOR ART
FIG. 6 is a block diagram of a driver of a conventional liquid-crystal display.
Figure 7:
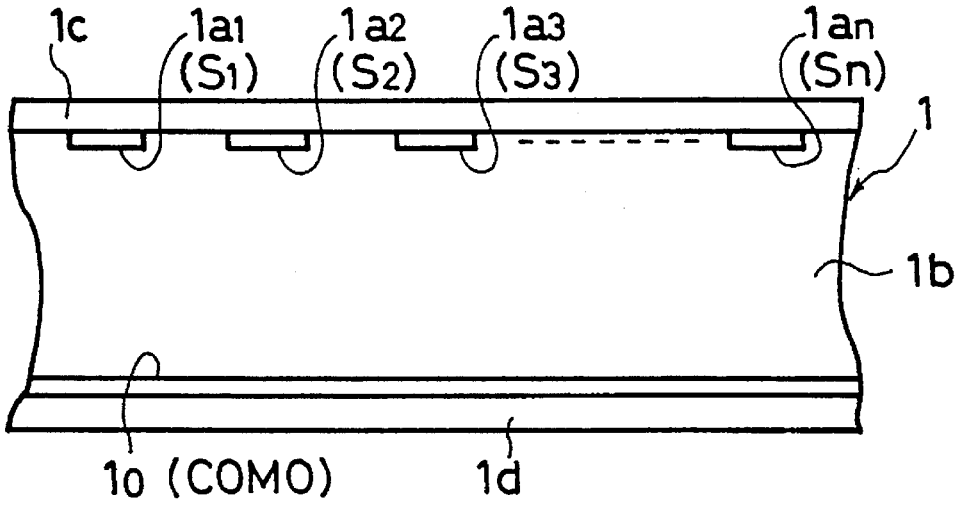
FIG. 7 is a diagram showing the structure of the liquid-crystal display panel of FIG. 6
Figure 8:
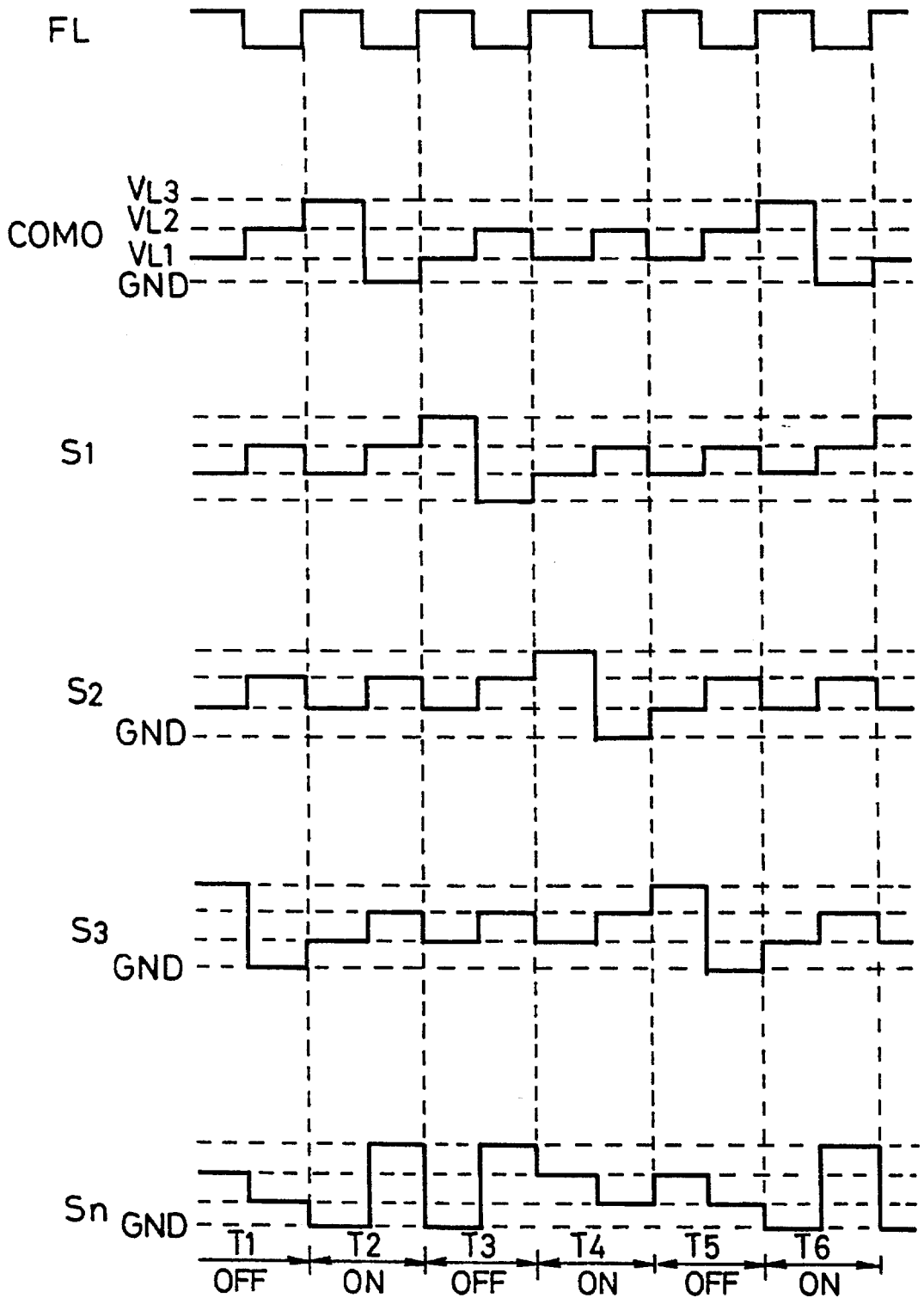
FIG. 8 PRIOR ART
FIG. 8 is a timing chart showing the waveforms of each section of FIG. 6.

FIG. 1 shows a block diagram of a liquid-crystal display according to the invention that includes a (⅓) bias driver. In the figure, 1 is a liquid-crystal display panel consisting of a liquid-crystal display circuit; 2 is an liquid-crystal driver; 3 is a power supply; 4 to 6 are resistors; $7_a$ to $7_c$ are grounds (GND); 10 to 12 are switches; 13 is a timing signal generation circuit; 14 and 15 are condensers; 20 is a frame frequency generator circuit; and 21 is an liquid-crystal power supply control circuit. 30 is a liquid-crystal power supply generation circuit comprised of power supply 3, resistors 4 to 6, ground (GND) $7_a$ to $7_c$, timing signal generation circuit 13, and condensers 14 and 15. Since the function of 1 to 6 and 20 are identical with that of a conventional liquid-crystal display, numbering is the same as in the figure of a conventional liquid-crystal display in FIG. 6 and explanations have been omitted. In liquid-crystal power generation circuit 30, power supply 3 is alternately connected to ground (GND) through resistors 4 to 6 and switches 10 to 12, and is connected to power supply input terminal $2_a$ of the liquid-crystal driver. One end of condenser 14 is connected to ground (GND) $7_b$ and the other to one end of resistor 5 and power supply input terminal $2_b$ of liquid-crystal driver 2. One end of condenser 15 is connected to ground $7_c$ and the other to one end of resistor 6 and to power supply input terminal $2_c$ of liquid-crystal driver 2.

Liquid-crystal power supply control circuit 21, in synchronization with each COMO, $S_1, \ldots S_n$ output signal to liquid-crystal display panel 1, outputs an interval control signal P before and after each output signal (for example,a COMO output signal) to liquid-crystal power supply generation circuit 30. When the interval control signal P of liquid-crystal power supply control circuit 21 is active, the liquid-crystal power supply generation circuit 30 supplies to liquid-crystal driver 2 plural power supply voltages of different levels required for display in the liquid-crystal display panel 1, derived from power supply $V_L$. The various power supply voltages are $V_{L3}$, $V_{L2}$, and $V_{L1}$ which are output to power supply input terminals $2_a$ to $2_c$ of liquid-crystal driver 2 following the division of power supply $V_L$ through resisters 4 to 6 positioned between power supply 3 and ground (GND) $7_a$. The supply voltages are $V_{L3}=V_L$, $V_{L2}=(2/3)\ V_L$, $V_{L1}=(1/3)V_L$. At this-time, switches 10 to 12 turn on. When the interval control signal P is not active, switches 10 to 12 turn off and power supply $V_L$ is cut off from ground (GND) $7_a$ and the liquid-crystal power supply generation circuit 30 enters hold status in which the supply voltages $V_{L2}$ and $V_{L1}$ to liquid-crystal driver 2 are held by condensers 14 and 15 which are respectively connected to ground (GND) $7_b$ and $7_c$ on one end. Timing signal generation circuit 13 outputs signals which simultaneously turn switches 10 to 12 on or off.

Figure 2:
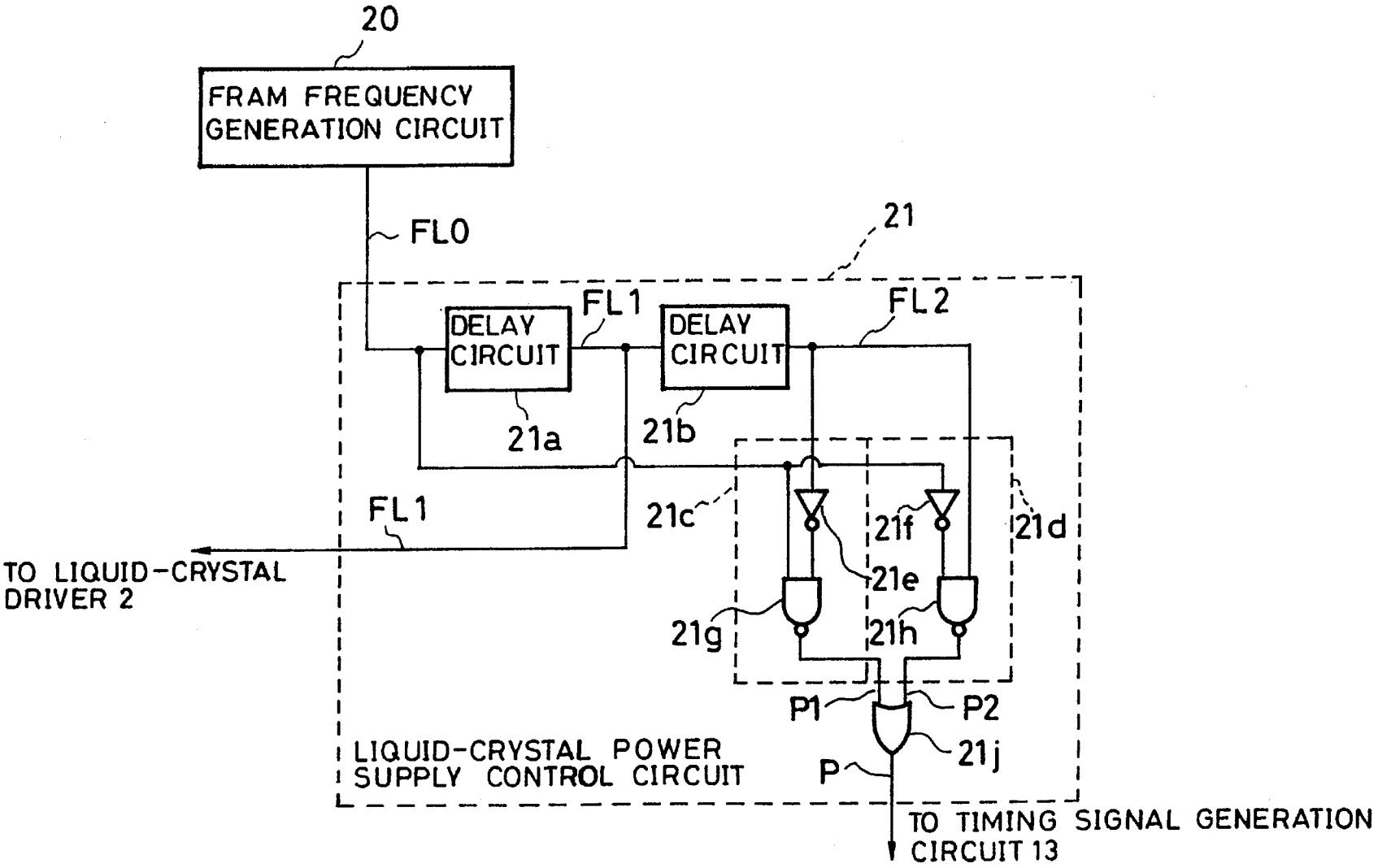
FIG. 2 is an example of a circuit diagram of the liquid-crystal power supply control circuit in FIG. 1.

FIG. 2 shows a circuit diagram of the liquid-crystal power supply control circuit in FIG. 1. In the figure, 21*a* and 21*b* are delay circuits and 21*j* is an OR element; 21*c* is a waveform shaping circuit consisting of inverter element 21*e* and NAND element 21*g*; 21*d* is a waveform shaping circuit consisting of inverter element 21*f* and NAND element 21*h*. Frame frequency generator circuit 20 is connected to the input side of delay circuit 21*a*, the input side of NAND element 21*g*, and to the input side of NAND element 21*h* through inverter element 21*f*. The output side of delay circuit 21*a* is connected to liquid-crystal driver 2 and the input side of delay circuit 21*b*. The output side of delay circuit 21*b* is connected to the input side of NAND element 21*g* through inverter element 21*e* and to the input side of NAND element 21*h*. The input side of OR element 21*j* is connected to the output side of NAND elements 21*g* and 21*h*, and its output side to the timing circuit. Delay circuit 21*a* successively shifts frame frequency signal FL0 from frame frequency generator circuit 20 and outputs to liquid-crystal driver 2 and delay circuit 21*b*. Waveform-shaping circuit 21*c* shapes pulse signal P1 between the rise of frame frequency signal FL0 of frame frequency generator circuit 20 and the rise of the output signal of delay circuit 21*b*. Waveform-shaping circuit 21*d* shapes pulse signal P2 between the rise of the frame frequency signal FL0 of frame frequency generator circuit 20 and the rise of the output signal of delay circuit 21. OR element 21*j* logically adds pulse signals P1 and P2 from waveform-shaping circuits 21*c* and 21*d* and outputs the resulting signal to timing signal generation circuit 13.

Figure 3:
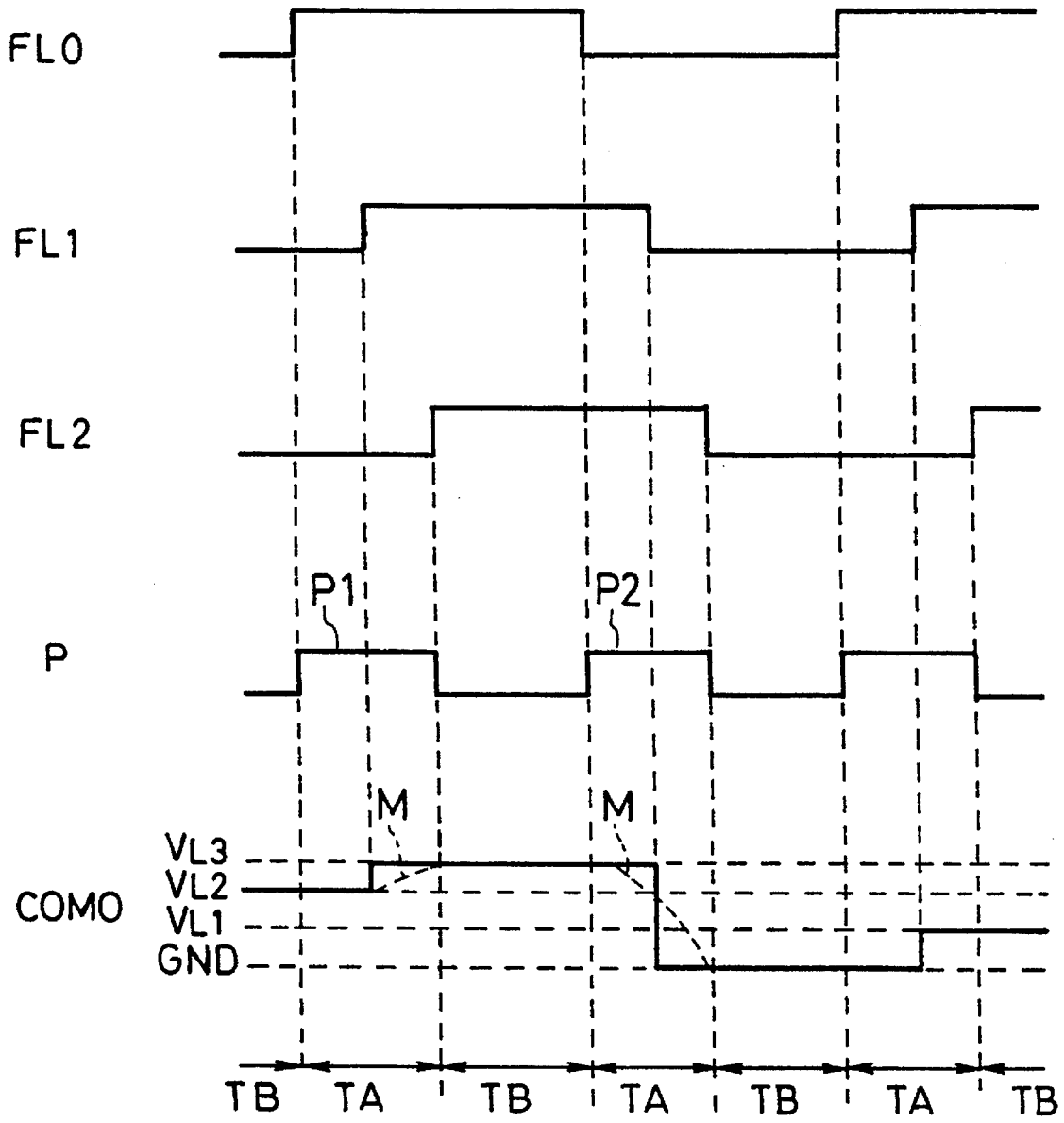
FIG. 3 is a timing chart showing the waveform of each section of FIG. 2.

FIG. 3 is a timing chart showing each output waveform of the the liquid-crystal power supply generator circuit of FIG. 2. In the figure, FL0 is the frame frequency signal output from frame frequency generator circuit 20 to delay circuit 21*a* and Waveform-shaping circuit 21*c*. FL1 is the frame frequency signal output from delay circuit 21*a* to delay circuit 21*b* and liquid-crystal driver 2, and FL2 is the signal output from delay circuit 21 to Waveform-shaping circuits 21*c* and 21*d*. P is the interval control signal output from OR gate element 21*j* to timing signal generation circuit 13 which includes pulse signal P1 of waveform-shaping circuit 21*c* and pulse signal P2 of waveform-shaping circuit 21*d*. As previously described, pulse signal P1 undergoes waveform-shaping by waveform-shaping circuit 21*c* between the rise of frame frequency signal FL0 and rise of signal FL2, and pulse P2 undergoes waveform-shaping by waveform-shaping circuit 21*d* between the rise of frame frequency signal FL0 and the fall of signal FL2. COMO is the signal output from liquid-crystal driver 2 (FIG. 1) to liquid-crystal display panel 1, GND, $V_{L1}$, $V_{L2}$, and $V_{L3}$ are voltages equal to the different supply voltages input to liquid-crystal driver 2 (FIG. 1), and broken line M is the waveform of the actual signal. Interval TA is the specific interval during which a change occurs in output signal COMO (as well as output signals $S_1$ to $S_n$) of liquid-crystal driver 2. Interval TB is the specific interval during which output signal COMO does not change.

Next, operation of embodiment of the invention shall be explained using FIGS. 1 to 3. In the case of a display using (⅓) bias, when switches 10 to 12 in liquid-crystal power supply generation circuit 30 (FIG. 1) are turned on by timing signal generation circuit 13 (during interval TB in FIG. 3), voltage $V_L$ of power supply 3 is divided by resistors 4 to 6—as explained in the example of a conventional liquid-crystal display—and supply voltages of $V_{L3}=V_L$, $V_{L2}=(2/3)V_L$, and $V_{L1}=(1/3)V_L$ are input to voltage supply input terminals $2_a$ to $2_c$ of liquid-crystal driver 2 as the power supply for the liquid crystals. Next, when switches 10 to 12 are turned off by timing signal generation circuit 13 (during interval TA in FIG. 3), the supply voltages input to voltage supply input terminals $2_a$ to $2_c$ are completely cut off from ground, terminating the power supply providing the supply voltages and causing a floating condition. Because of this, the maintenance of the supply voltages to voltage supply input terminals $2_a$ to $2_c$ is performed by the electrical charge provided by condensers 14 and 15. In this way, with the supply voltages being maintained at power input terminals $2_a$ to $2_c$, the timing for turning off switches 10 to 12 may be set to the time the signal from liquid-crystal driver 2 changes (interval TA in FIG. 3) through the timing signal generation circuit 13. Since only the volumetric components are displayed on liquid-crystal display panel 1, the voltages at power supply terminals $2_a$ to $2_c$ maintained by condensers 14 and 15 are sufficient, and with switches 10 to 12 off, reduced power consumption is achieved. During interval TB in FIG. 3, switches 10 to 12 turn on again and the supply voltages are supplied to liquid-crystal driver 2. At this time, a distortion in waveform is generated in the COMO signal sent from liquid-crystal driver 2 to liquid-crystal display panel 1, as shown by broken line M in FIG. 3. However, this distortion can be prevented from affecting the liquid-crystal picture element illumination by setting the size of resistors 4 to 6 and condensers 14 and 15.

Figure 4:
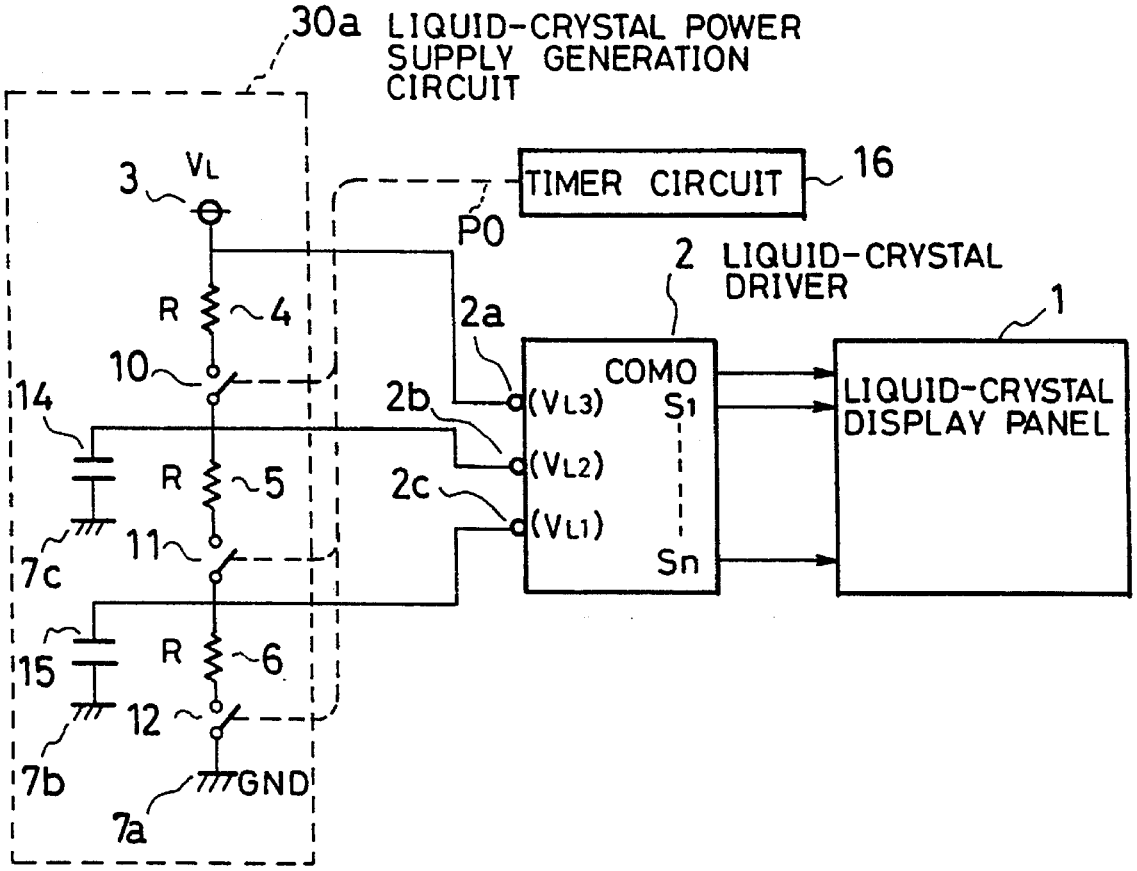
FIG. 4 is block diagram of a driver of an liquid-crystal display according to an embodiment of the invention.

FIG. 4 is a block diagram of an embodiment of a liquid-crystal display circuit according to another invention. In the figure, 16 is a timer circuit. Compared with the embodiment of the first invention (FIG. 1), timer circuit 16 is a new addition. Except for the absence of timing signal generation circuit 13, frame frequency generator circuit 20, and liquid-crystal power control circuit 21, the internal structure and connections of this embodiment are basically the same as those of the first invention, and thus no explanation is given for them. Timer circuit 16 outputs interval control signal PO that turns switches 10 to 12 on and off at a specific times.

Figure 5:
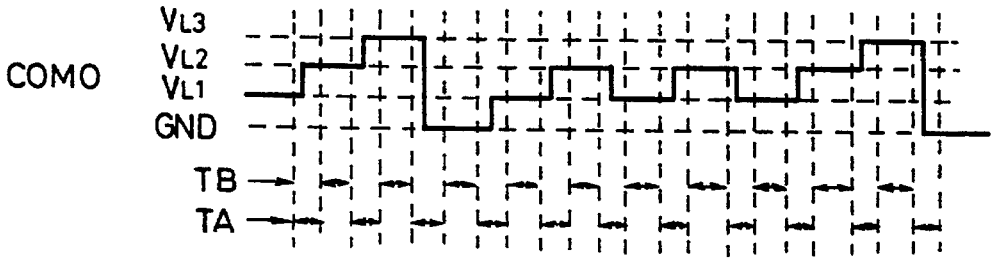
FIG. 5 is a waveform diagram of the signals output from the liquid-crystal display driver of FIG. 4.

FIG. 5 is a waveform diagram of the output waves of the liquid-crystal driver of FIG. 4. The figure shows the relationships between: output signal COMO sent from liquid-crystal driver 2 to liquid-crystal display panel 1, interval TB (switches 10 to 12: off) at which time output signal COMO changes, and interval TB (switches 10 to 12: on) at which time output signal COMO does not change. The voltage levels for GND and $V_{L1}$ to $V_{L3}$ are the same as the supply voltages supplied to power supply terminals $2_a$ to $2_c$ of liquid-crystal driver 2.

Next, operation of the embodiment of a liquid-crystal display circuit according to another invention shall be explained using FIGS. 4 and 5. In FIG. 4, timer 16, in which intervals TA and TB have been preset, turns switches 10 to 12 on (interval TB in FIG. 5) and voltages of $V_{L3}=V_L$, $V_{L2}=(2/3)V_L$ and $V_{L1}=(1/3)V_L$ are input from liquid-crystal power supply generator circuit 30*a* to power supply terminals $2_a$ to $2_c$ of liquid-crystal driver 2, providing supply voltages for liquid-crystal operation. Next, when timer 16 turns switches 10 to 12 off (interval TA in FIG. 5), the supply voltages input to power supply terminals $2_a$ to $2_c$ are completely cut off and the power supply for the supply voltages changes to floating status. The maintenance of supply voltages to power supply terminals $2_a$ to $2_c$ of liquid-crystal driver 2 is performed by the electrical charges of condensers 14 and 15, which are connected on one side to grounds (GND) $7_c$ and $7_b$, respectively. The on-off control of switches 10 to 12 is performed through overflow of a general-purpose timer. In other words, with the supply voltages to power supply terminals $2_a$ to $2_c$ maintained by the electrical charges in condensers 14 and 15, the electrical charges in condensers 14 and 15 gradually discharge, and timer 16 is set to keep the switches off until the voltages at power supply terminals $2_a$ to $2_c$ fall to a specific level, and to keep them on until the voltages at power supply terminals $2_a$ to $2_c$ of liquid-crystal driver 2 returns to a specific level during the charging of condensers 14 and 15.

As explained above, the invention provides a liquid-crystal power supply generating circuit that supplies plural supply voltages of different levels when an interval control signal from a liquid-crystal power supply control circuit is active, and maintains the supply voltages when the said interval control signal is inactive, thus enabling the creation of liquid-crystal displays with lower power consumption than conventional liquid-crystal displays.

The other invention provides a structure that enables the output of interval control signals from a timer circuit, which, combined with the effect of the first invention, enables the creation of a liquid-crystal display with a simpler structure than that of the first invention.

What is claimed is:

1. A system for achieving reduced power consumption in operation of a liquid-crystal display comprising:

a liquid-crystal driver, coupled to receive a frame frequency signal and plurality of input voltage level signals, for generating a plurality of control signals having magnitudes equal to selected voltage level signals to drive a liquid-crystal display, with said driver for changing the magnitudes of said control signals at transition times derived from said frame frequency signal;

a liquid-crystal power supply control circuit, coupled to receive said frame frequency signal and including an output delay circuit that delays said frame frequency signal by a given duration and a waveform-shaping circuit that shapes and outputs signals from said output delay circuit, wherein said power supply control circuit outputs an interval control signal to define a first time interval that includes the transition times when the magnitudes of said control signals are changed and a second time interval when the magnitudes of said control signals do not change; and a liquid-crystal power supply generation circuit, having inputs coupled to receive power and ground voltage levels, and said interval control signal, and having outputs to provide said voltage level signals to said liquid crystal driver, and including a plurality of capacitors coupled between said liquid-crystal driver and said ground voltage level, for driving said voltage level signals from said received power and ground signals and for charging said capacitors to said voltage level signals when said interval control signal defines said second time intervals and for driving said control signals from said charged time interval.

2. The system according to claim 1 wherein said liquid-crystal power supply control circuit further comprises:

a first delay circuit coupled to receive said frame frequency signal;

a second delay circuit coupled to said first delay circuit;

a waveform-shaping circuit coupled to said second delay circuit;

an OR-gate coupled to said waveform-shaping circuit;

an output of said OR-gate coupled to said liquid-crystal power supply generation circuit.

3. The system according to claim 1 wherein said waveform-shaping circuit is comprised of NAND and other logic elements.

4. A system for achieving reduced power consumption in operation of a liquid-crystal display comprising:

a liquid-crystal driver, coupled to receive a frame frequency signal and plurality of input voltage level signals, for generating a plurality of control signals having magnitudes equal to selected voltage level signals to drive a liquid-crystal display, with said driver for changing the magnitudes of said control signals at transition times derived from said frame frequency signal;

a timer circuit that outputs an interval control signal at preset intervals that define a first time interval that includes the transition times when the magnitudes of said control signals are changed and second time intervals when the magnitudes of said control signals do not change; and a liquid-crystal power supply generation circuit, having inputs coupled to receive power and ground voltage levels, and said interval control signal, and having outputs to provide said voltage level signals to said liquid crystal driver, and including a plurality of capacitors coupled between said liquid-crystal driver and said ground voltage level, for driving said voltage level signals from said received power and ground signals and for charging said capacitors to said voltage level signals when said interval control signal defines said second time interval and for driving said control signals from said charged capacitors when said interval control signal defines said first time interval.

5. The system according to claims 1, 2, 3 or 4 wherein said liquid-crystal power supply generation circuit is comprised of switches positioned in line with serially connected plural resistors and dividing the power supply by the ratio of each resistance value by connecting with the serially connected resistors when turned on, and a timing circuit that outputs signals that turn on the switches during the said active status.

6. A system for achieving reduced power consumption in operation of a liquid-crystal display comprising:

a liquid-crystal driver, coupled to receive a frame frequency signal and plurality of input voltage level signals, for generating a plurality of control signals having magnitudes equal to selected voltage level signals to drive a liquid-crystal display, with said driver for changing the magnitudes of said control signals at transition times derived from said frame frequency signal;

a liquid crystal power supply control circuit comprising:

a first delay circuit coupled to receive said frame frequency signal;

a second delay circuit coupled to said first delay circuit;

a waveform-shaping circuit coupled to said second delay circuit; and an OR-gate coupled to said waveform-shaping circuit, wherein said liquid crystal power supply control circuit outputs an interval control signal to define a first time interval that includes the transition times when the magnitudes of said control signals are changed and a second time interval when the magnitudes of said control signals do not change; and a liquid-crystal power supply generation circuit, having inputs coupled to receive power and ground voltage levels and said interval control signal and having outputs to provide said voltage level signals to said liquid crystal driver, and including a plurality of capacitors coupled between said liquid-crystal driver and said ground voltage level, for driving said voltage level signals from said received power and ground signals and for charging said capacitors to said voltage level signals when said interval control signal defines said second time intervals and for driving said control signals from said charged capacitors when said interval control signal defines said first time interval.

* * * * *